US005220813A

United States Patent [19]

Chen et al.

[11] Patent Number: 5,220,813

[45] Date of Patent: Jun. 22, 1993

[54] UNIFIED WASHING-DRYING MACHINE

[76] Inventors: Haw-Renn Chen; Feichu H. Chen, both of 4057 Little Hollow Pl., Moorpark, Calif. 93021

[21] Appl. No.: 763,499

[22] Filed: Sep. 23, 1991

Related U.S. Application Data

[63] Continuation-in-part of Ser. No. 207,223, Jun. 13, 1988, abandoned.

[51] Int. Cl.[5] ..... D06F 19/00

[52] U.S. Cl. ..... 68/3 SS; 68/13 R; 68/20; 68/183; 68/133; 34/1 P; 34/241

[58] Field of Search ..... 68/13 R, 20, 17.1, 183, 68/15, 355, 28, 133; 34/1, 241

[56] References Cited

U.S. PATENT DOCUMENTS

| | | | |
|---|---|---|---|
| 1,133,890 | 3/1915 | Stamm | 68/133 U X |
| 1,836,063 | 12/1931 | Bloom | 68/183 |
| 3,734,688 | 5/1973 | Fairney | 68/20 |
| 3,841,117 | 10/1974 | Crivilles | 68/20 |
| 4,103,431 | 8/1978 | Levinson | 34/1 |
| 4,393,671 | 7/1983 | Ito | 34/1 |
| 4,510,697 | 4/1985 | Beasley et al. | 34/1 |
| 4,523,387 | 6/1985 | Manan | 34/1 |
| 4,703,565 | 11/1987 | Kantor | 68/20 X |
| 4,744,228 | 5/1988 | Golberg | 68/20 |
| 4,757,697 | 7/1988 | Arreghini et al. | 68/20 X |
| 4,765,066 | 8/1988 | Yoon | 34/1 |
| 4,771,156 | 9/1988 | Strattan et al. | 34/1 |

FOREIGN PATENT DOCUMENTS

| | | | |
|---|---|---|---|
| 1296178 | 5/1962 | France | 68/183 |
| 59-8999 | 1/1984 | Japan | 68/183 |
| 60-55996 | 4/1985 | Japan | 68/183 |
| 60-111690 | 6/1985 | Japan | 68/183 |
| 62-120893 | 1/1987 | Japan | 68/183 |

*Primary Examiner*—Frankie L. Stinson

[57] ABSTRACT

In a unified washing-drying machine, the use of conventional drying means is eliminated and, instead, an electromagnetic heating system is provided at an appropriate place in the unified washing-drying machine as a means to thermally evaporate the remaining moisture in the washed fabrics during the drying cycle. A high-pressure air system with the air nozzle assemblies imbedded on the agitator is installed in the unified washing-drying machine such that the high-pressure air flow from the air nozzle assemblies can float the washed fabrics to have the evaporated steam or water vapor removed efficiently. Also, the high-pressure air flow can have the washed fabrics circulate and tumble well to prevent wrinckles from setting on the washed fabrics. Thus, with the invented unified washing-drying machine contineous, uninterrupted cleaning and drying cycles can be achieved with the additional benefit of saving space by eliminating an extra dryer installment as in a conventional laundry system. In addition, a higher wash and rinse efficiency is obtained through the water turbulence induced by the injected high-pressure air flow from the air nozzle assemblies during the wash and rinse cycles.

12 Claims, 1 Drawing Sheet

UNIFIED WASHING-DRYING MACHINE

This is a continuation of application Ser. No. 07/207,223, filed Jun. 13, 1988, now abandoned.

BACKGROUND OF THE INVENTION

A laundry process contains two basic steps which are cleaning and drying cycles. A cleaning cycle in turn contains wash, rinse, and spin cycles. Since a conventional laundry system comprises a washer and a dryer to do cleaning and drying respectively, a laundry needs to be loaded twice for the cleaning cycle and the drying cycle. The extra attendance for loading the fabrics into dryer is quite inconvinient and time consuming. Also, a laundry system with two machine installments not only costs more but also takes more space of a residential area than an one-installment laundry system. The present invention is concerned with these problems, and it is the general aim of this invention to provide a unified washing-drying machine which may be utilized for performing cleaning and drying cycles in only one installment.

SUMMARY OF THE INVENTION

In accordance with the present invention, both cleaning and drying capabilities are provided in the unified washing-drying machine by introducing an innovative washing/drying concept into the laundry system. Unlike the conventional drying method which utilizes convected heat as a major drying heat source and conducted heat as a supplemental drying heat source, the present invention uses the electromagnetic energy as a major drying heat source and both convected and conducted heat as the minor drying heat sources in the drying cycle such that a washer and a dryer can be merged in one installment and a higher heating efficiency can be obtained. In addition, high pressure air flow is injected into water during the wash and rinse cycles to increase the water turbulence such that a better cleaning efficiency can be achieved.

DETAIL DESCRIPTION OF THE EMBODIMENT

Figure 1:
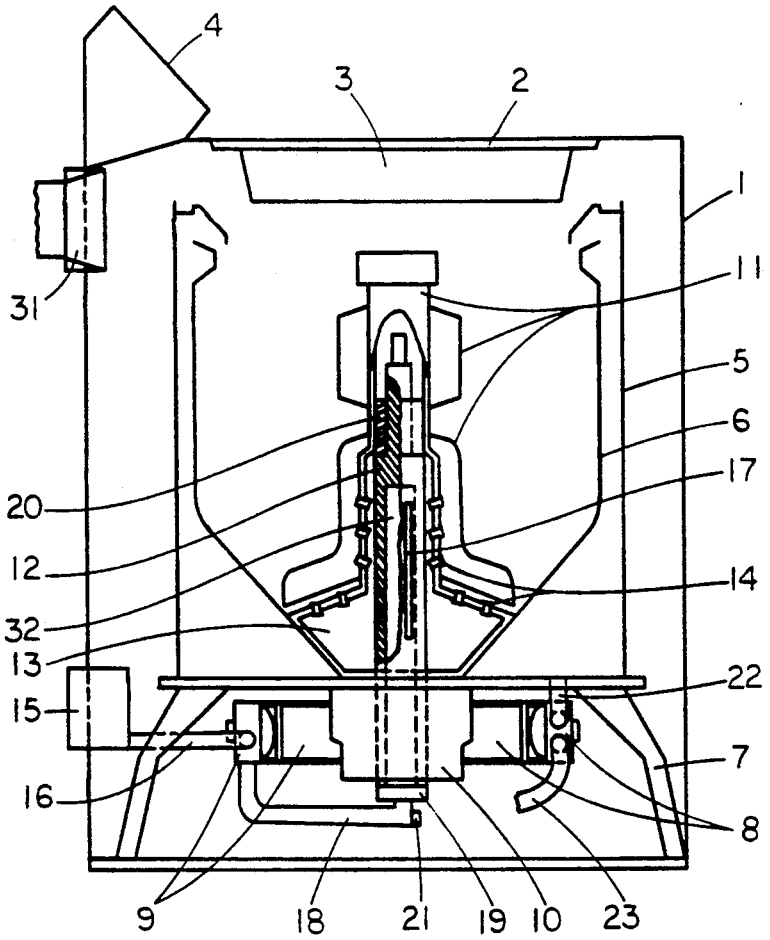
FIG. 1 shows the sectional view of the basic configuration of the present invention.

A unified washing-drying machine is an article of appliance for performing both cleaning and drying functions within a singular installment with the basic configuration as shown in FIG. 1. A confinement means, preferably as a housing, with an access means 2, preferably installed at the top of the confinement means, to access the interior of the confinement means is indicated by 1. A control means, preferably comprising both cleaning cycle control and drying cycle control, installed at appropriate location on the unified washing-drying machine, preferably installed as a control console extruding upwards over the top and at the side away from the front end of the confinement means, is indicated by 4. A containing means preferably comprising a perforated inner containing means 6, which has a slope at the bottom portion from periphery to center and is used to contain the fabric articles or clothings to be cleaned or dried, and a coaxial outer containing means 5, which is used to contain liquid phase substance to clean the fabric articles or clothings within the perforated inner containing means and to confine any flowing substance from escaping through, is supported by a supporting means 7. An electromagnetic heating means, preferably being a microwave generator installed underneath the access means 2 at the top of the confinement means 1, with the electromagnetic energy, such as microwave energy, directed onto the fabric articles or clothings to be dried is indicated by 3. A flowing substance agitating means, which is used to agitate the flowing substance or to affect the flowing directions of the flowing substance, preferably installed coaxial to the containing means, is indicated by 11.

A flowing substance transport means, which is used to drive and convey working flowing substances such as liquid phase substance or gas phase substance to achieve the purpose of cleaning and drying fabric articles or clothings, comprises a flowing substance driving means, a flowing substance conveying means, and a driving energy conveyance adjustment means. The flowing substance driving means preferably comprises a liquid phase substance driving means 8 and a gas phase substance driving means 9. The flowing substance conveying means preferably comprises a liquid phase substance conveying means and a gas phase substance conveying means. The liquid phase substance conveying means is indicated by 22 and 23. The gas phase substance conveying means comprises preferably a gas phase substance cleaning means 15, gas phase conducting means 16 and 18, an internal flowing substance conduit 32 formed in a flowing substance agitating energy conveyance means 12, an interconnection means 19, a gas phase substance accumulating space 13, and flowing substance accelerating means 14. The gas phase substance cleaning means 15 is preferably installed at the back side of the confinement means 1. A flowing substance pass way 17 is formed on the flowing substance agitating energy conveyance means 12 to allow gas phase substance going from the internal flowing substance conduit 32 to the gas phase substance accumulating space 13. The interconnection means 19 is to interconnect the gas phase substance conducting means 18 and the internal flowing substance conduit 32 in the flowing substance agitating energy conveyance means 12. The gas phase substance accumulating space 13 is in connection with the inlets of the flowing substance accelerating means 14 and can allow the acoustic means, such as an ultrasonic wave generation means, or a vibration means, such as a high frequency vibration generation mean, to be installed therein. The driving energy conveyance adjustment means 10 preferably placed close to the flowing substance driving means is used to convert the driving energy from the flowing substance driving means to proper motions of the containing means or the flowing substance agitating means during the cleaning or the drying cycles. A flowing substance sealing means 20 is placed at appropriate locations over the flowing substance agitating energy conveyance means 12 within the flowing substance agitating means 11 to prevent the flowing substance from leaking. With this preferred arrangement of the flowing substance transport means, the gas phase substance is driven from the gas phase substance cleaning means 15 through the gas phase substance conducting means 16 and 18, the gas phase substance driving means 9, the flowing substance conduit 32, and the flowing substance pass way 17 to the gas phase substance accumulating space 13 such that gas phase substance pressure and other physical properties are built up therein. A flowing substance safety guard means 21 is installed at an appropriate location on the flowing substance transport means to safe-guard the physical properties, such as pressure, etc., of the flowing substance.

Figure 2:
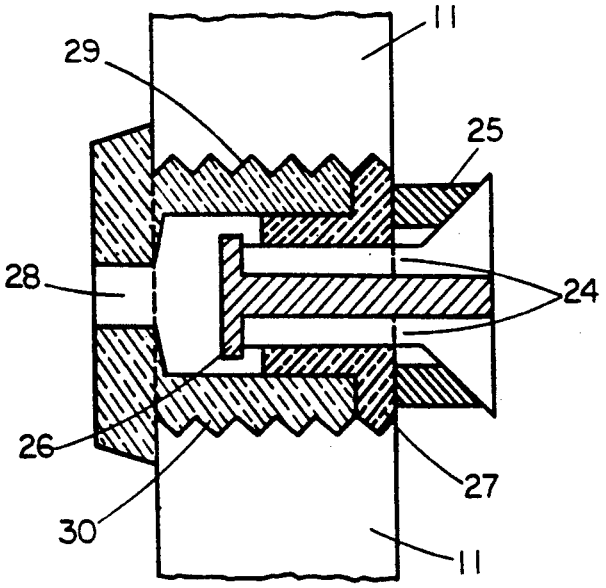
FIG. 2 shows the sectional view of the air nozzle assembly installed on the agitator wall.

A preferred arrangement of the flowing substance accelerating means is shown in FIG. 2 wherein flowing substance flow channels 24 serving as the inlets of the flowing substance accelerating means are in connection with the gas phase substance accumulating space 13. As depicted in FIG. 2, an elastically flexible means 25 is installed at the side next to gas phase substance accumulating space in the way that flowing substance flow adjustment means 26 is pushed by the elastically flexible means 25 toward the gas phase substance accumulating space 13 such that flowing substance flow channels 24 formed in the flowing substance flow adjustment means are partially or completely blocked by a flowing substance flow adjustment assisting means 27 such that gas phase substance flows are restricted or shut off when the gas phase substance pressure in the gas phase substance accumulating space 13 is below a setpoint preferably determined by the flowing substance flow adjustment means 26 and the elastically flexible means 25. Once the gas phase substance pressure in the gas phase substance accumulating space 13 is higher than the setpoint, the flowing substance flow adjustment means 26 will be forced against the elastically flexible means 25 and will move toward flowing substance accelerating means outlet 28, formed on an auxiliary means 30 at the side of the flowing substance accelerating means opposite from the elastically flexible means 25, until the gas phase substance flow through the flowing substance flow channels 24 and the gas phase substance flow from the gas phase substance driving means 9 are equivalent. A preferred elastically flexible means 25 is an innovated taper spring which is configured as a solid block formed with any shape of through-hole wherein either the periphery of the solid block or the size of the through-hole is varying from one end of the solid block to the other end such that, when in conjunction with a matching solid block with a surface configured to match the through-hole or the periphery of the taper spring solid block, an interacting force can be generated through the contacting surfaces of the aforementioned solid blocks. As an explanary example, a taper spring can be configured as a ring with an inner or outer taper surface and a radial opening such that the ring can be expanded, for a ring with inner surface tapered, or compressed, for a ring with outer surface tapered, by a load applied on the taper surface. To make the flowing substance accelerating means replaceable, fastening means 29, such as threads, is formed on the flowing substance accelerating means 14 or at appropriate location on the flowing substance agitating means 11 wherever the flowing substance accelerating means is to be installed. The auxiliary means 30 is used to support the flowing substance accelerating means 14 and as a means to confine the flowing substance flow adjustment means 26.

The flowing substance transport means can serve the unified washing-drying machine as a high-pressure gas phase substance floating system which can float the washed fabric articles or clothings during drying cycle and cool-down cycle. While the drying cycle utilizes the high-pressure gas phase substance floating system with the electromagnetic heating means 3 turned on, the cool-down cycle, which normally follows the drying cycle, utilizes the high-pressure gas phase substance floating system with the electromagnetic heating means 3 turned off. Also, the high-pressure gas phase substance from the high-pressure gas phase substance floating system can be injected into liquid phase substance during the wash cycle or rinse cycle. The process of injecting high-pressure flowing substance flow into the liquid phase substance can have high efficiency on washing or rinsing the fabric articles or clothings to be cleaned.

The installation of the electromagnetic heating means in the unified washing-drying machine as a heating source can have the advantage of good heating efficiency and uniform heat distribution on the fabric articles or clothings to be cleaned during the drying cycle or the like. During the drying cycle, the electromagnetic heating means is turned on automatically and the gas phase substance accumulating space 13 is pressurized by the gas phase substance driving means 9. Once the pressure of the gas phase substance in the gas phase substance accumulating space 13 is higher than a setpoint, the high pressure gas phase substance will be released through the flowing substance accelerating means 14 and the high-pressure gas phase substance flow from the flowing substance accelerating means will float the washed fabric articles or clothings. Since the washed fabric articles or clothings are heated by the electromagnetic heating means, remaining liquid phase substance in the washed fabric articles or clothings will be evaporated and removed by the gas phase substance flow. Also, preferably, the gas phase substance accelerating means 14 on the flowing substance agitating means 11 are arranged in the way that the washed fabric articles or clothings will be floated from the base of the flowing substance agitating means and be blown out radially toward the wall of the containing means, and then drop back to the lower portion of the flowing substance agitating means. The arrangement of the high-pressure gas phase substance floating system along with the electromagnetic heating means is intended to have the washed fabric articles or clothings circulate or extend well such that the evaporated liquid phase substance remaining in the washed fabric articles or clothings can be removed efficiently and the fabric wrinkles can be prevented from setting. Gas phase substance extracting means 31, as shown in FIG. 1, is installed at the back of the unified washing-drying machine such that the gas phase substance carrying the evaporated liquid phase substance from the washed fabric articles or clothings can be extracted out of the machine.

As mentioned previously, an ultrasonic wave generation means or a high frequency vibration generation means can be installed in the gas phase substance accumulating space 13. When the ultrasonic wave generation means or the high frequency vibration generation means is installed in 13, ultrasonic wave or high frequency vibration can be transmitted into the liquid phase substance in the inner containing means 6 and then, through the liquid phase substance, be transmitted to the fabrics to be cleaned to have the fabrics be cleaned effectively. The ultrasonic wave generation means or the high frequency vibration generation means can be applied alone to clean the fabrics without the flowing substance agitating means; nevertheless, the ultrasonic wave generation means or the high frequency vibration generation means can also be applied with the flowing substance agitating means to enhance the cleaning effectiveness by having the liquid phase substance in the containing means 6, and hence the fabrics therein, be agitated and circulated thereof.

We claim:

1. An article of appliance for cleaning or drying fabric articles comprising a confinement means having an access means thereof, a containing means for receiving said fabric articles through said access means, an electromagnetic heating means within said confinement means, an acoustic wave generation means and a flowing substance transport means whereby said fabric articles can be cleaned by said acoustic wave generation means and can be dried with electromagnetic heating energy generated from said electromagnetic heating means being directed onto said fabric articles and with gas phase substance driven by said flowing substance transport means circulating and extending said fabric articles.

2. An article of appliance for cleaning or drying fabric articles as set forth in claim 1 wherein said electromagnetic heating means generates microwave energy.

3. An article of appliance for cleaning or drying fabric articles as set forth in claim 1 wherein said containing means has slope from periphery to center at the lower portion.

4. An article of appliance for cleaning or drying fabric articles as set forth in claim 1 wherein said flowing substance transport means comprises gas phase substance driving means and gas phase substance conveying means.

5. An article of appliance for cleaning or drying fabric articles as set forth in claim 1 wherein said flowing substance transport means has gas phase substance accumulating space.

6. An article of appliance for cleaning or drying fabric articles as set forth in claim 1 wherein said flowing substance transport means comprises liquid phase substance driving means and liquid phase substance conveying means.

7. An article of appliance for cleaning or drying fabric articles as set forth in claim 1 wherein said acoustic wave generation means comprises ultrasonic wave generation means.

8. An article of appliance for cleaning or drying fabric articles as set forth in claim 1 wherein said flowing substance transport means injects liquid phase substance into said containing means.

9. An article of appliance for cleaning or drying fabric articles with a confinement means having an access means thereon, a containing means for receiving said fabric articles through said access means, an electromagnetic heating means within said confinement means, and a flowing substance agitating means having flowing substance accelerating means thereon with the improvement comprising said flowing substance accelerating means being capable of delivering gas phase substance in the drying cycles for lifting fabrics being dried in said drying cycles and carrying away the liquid phase substance contained in said fabrics being dried while radiant energy from said electromagnetic heating means being placed directly onto said fabrics being dried and said liquid phase substance contained therein whereby, by directly placing radiant energy onto said fabrics being dried and said liquid phase substance therein without indirectly heating additional heating media substance and having said fabrics being dried be heated and lifted at the same time to have said liquid phase substance contained therein carried away by said gas phase substance that is lifting said fabrics being dried, heating energy is conserved by eliminating energy loss over heating said additional heating media substance and drying effectiveness is enhanced while incorporation of lifting said fabrics by said gas phase substance and placing said radiant energy directly onto said fabrics being dried enables performance of washing/drying cycles in timely order.

10. An article of appliance for cleaning or drying fabric articles as set forth in claim 9 wherein said electromagnetic heating means generates microwave energy.

11. An article of appliance for cleaning or drying fabric articles as set forth in claim 9 wherein said containing means has slope from periphery to center at the lower portion.

12. An article of appliance for cleaning or drying fabric articles as set forth in claim 9 wherein said gas phase substance comprises air.

* * * * *